US011596995B2

(12) United States Patent
Argadine et al.

(10) Patent No.: US 11,596,995 B2
(45) Date of Patent: Mar. 7, 2023

(54) BENDING DIE ASSEMBLY WITH SPLIT DIE AND METHOD FOR USING

(71) Applicant: Morton Industries LLC, Morton, IL (US)

(72) Inventors: Russ Argadine, Delavan, IL (US); Justin Barnewolt, Mackinaw, IL (US); Gary Schmitt, East Peoria, IL (US); Curt Humes, Glasford, IL (US)

(73) Assignee: Morton Industries LLC, Morton, IL (US)

( * ) Notice: Subject to any disclaimer, the term of this patent is extended or adjusted under 35 U.S.C. 154(b) by 108 days.

(21) Appl. No.: 17/352,513

(22) Filed: Jun. 21, 2021

(65) Prior Publication Data

US 2022/0402014 A1 Dec. 22, 2022

(51) Int. Cl.
*B21D 37/10* (2006.01)
*B21D 7/02* (2006.01)

(52) U.S. Cl.
CPC ..... *B21D 37/10* (2013.01); *B21D 7/02* (2013.01)

(58) Field of Classification Search
CPC ..... B21D 7/02; B21D 7/021; B21D 7/024; B21D 7/04; B21D 37/10
See application file for complete search history.

(56) References Cited

U.S. PATENT DOCUMENTS 2,806,505 A * 9/1957 Minarczyk, Jr. ..... B21D 11/02 72/158
3,335,588 A 8/1967 Cummings
4,009,601 A * 3/1977 Shimizu ..... B21D 9/073 29/445
4,038,853 A * 8/1977 Schwarze ..... B21D 7/024 72/157
5,092,150 A 3/1992 Cunningham
5,123,272 A 6/1992 Heaman
5,142,895 A * 9/1992 Schuchert ..... F28F 1/006 72/149
5,284,041 A 2/1994 Christensen et al.
5,337,590 A * 8/1994 Schuchert ..... B21D 7/02 72/157
6,298,706 B1 10/2001 Dunn
7,171,835 B2 2/2007 Nakazato
7,743,636 B2 6/2010 Rusch
(Continued)

FOREIGN PATENT DOCUMENTS

GB 191513853 A * 9/1916 ..... B21D 7/06
JP 2015107503 12/2015

*Primary Examiner* — Edward T Tolan
(74) *Attorney, Agent, or Firm* — Nyemaster Goode, P.C.

(57) ABSTRACT

A die assembly having a bending die and a clamp die. The bending die comprises one or more movable plates and a wedge plate. The bending die includes a channel formed in one or more of the plates configured to receive a pipe or other workpiece to be formed. The movable plates are movable between a first position wherein each plate is spaced from the adjacent plate a predetermined distance and a second position wherein each plate is compressed so there is less distance between the plates. Movement of the wedge plate from the retracted position to the engaged position causes the movable plates to move from the first position to the second position. Compression of the movable plates correspondingly reduces the width of the channel to help grasp any workpiece inserted therein.

8 Claims, 9 Drawing Sheets

(56) References Cited

U.S. PATENT DOCUMENTS

| | | | | |
|---|---|---|---|---|
| 8,511,123 | B2 | 8/2013 | Scoville et al. | |
| 10,675,667 | B2 * | 6/2020 | Nozu | B21D 35/003 |
| 2016/0059298 | A1 * | 3/2016 | Hattori | B21D 28/32<br>72/333 |

* cited by examiner

BENDING DIE ASSEMBLY WITH SPLIT DIE AND METHOD FOR USING

BACKGROUND

This invention relates to a bending die assembly configured to be combined with a bending machine for bending workpieces such as tubes, pipes, rods, or bars. There are a variety of different types of bending machines known in the industry. One type of bending machine is a rotary draw bender. An example of a rotary draw bending machine is disclosed in U.S. Pat. No. 7,743,636 (Rusch), which is incorporated by this reference. A rotary draw bending machine uses a bending die with a concave groove or channel configured to receive the workpiece. The channel is uniform in shape and diameter around at least part of the outer circumference of the bending die. The bending die has a corresponding die, generally referred to as a clamp die, and a pressure die to bend the workpiece. Together the bending die and the clamp die form the die assembly. The clamp die has a concave channel along its length which corresponds to the channel in the bending die. The diameter of the channels of each die assembly generally matches the outside diameter of the tubular workpiece they will bend.

The die assembly is combined with the bending machine such that the clamp die is able to move toward the bending die after the workpiece is positioned within the channel of the bending die to capture the workpiece between the dies. The bend arm of the bending machine rotates the die assembly around a central axis, which is typically the central axis of the bending die, causing the workpiece to bend around the circumference of the bending die. After the bending operation, the one or more clamp dies are retracted from the bending die and the workpiece is removed from the channel.

In general, as the die assembly is rotated and the workpiece is bent, the outer part of the workpiece is stretched at the bend and the inner section of the workpiece is compressed at the bend. As a result of these opposite and unequal stresses, the workpiece tends to distort, flatten, buckle, or even collapse, thereby destroying the utility of the workpiece. Buckling occurs when the resistance to bending of the workpiece becomes greater than the resistance to buckling.

Over the years, the tensile strength of steel pipe and other workpieces has been increased to allow the use of thinner wall pipe in the some applications. The reason for this change is the savings realized from the reduced amount of total steel required. However, it is well known that thin wall pipe distorts and buckles more easily than thicker wall pipe. The most common location for distortion and buckling is in the portion of the pipe adjacent to the last one third of the bending die.

One solution for preventing distortion and buckling is to support the wall of the workpiece in some manner during the bending operation. The support helps to minimize the adverse effect of the opposite and unequal stresses induced during bending. Some existing bending dies use a hydraulic cylinder to press downward on the bending die to reduce the width of the groove after the workpiece has been inserted therein. This helps the walls of the channel grasp and support the workpiece during the bending operation, however, hydraulic cylinders require significant maintenance and can be messy. Further, some bending machines are electric and do not have a hydraulic line to tap into.

There is therefore a need for an improved die assembly for a pipe/tube bending machine which overcomes these and other drawbacks.

SUMMARY

One aspect of the invention includes a die assembly configured to be combined with a bending machine for bending a workpiece. The die assembly comprises a bending die having a post, a first plate secured to an upper portion of the post and a second plate secured to a lower portion of the post, at least two movable plates secured between the first plate and the second plate, wherein the movable plates are movable along the post between a first position and a second position, a channel at least partially formed in one of the movable plates and configured to receive the workpiece, the channel having a width, and a wedge plate positioned between the first plate and the second plate. The wedge plate is configured to be movable relative to the movable plates between a retracted position and an engaged position so that movement of the wedge plate from the retracted position to the engaged position is configured to cause the movable plates to move to from the first position to the second position reducing the width of the channel. The die assembly further comprises a clamp die configured to move toward the bending die after the workpiece is positioned within the channel to help secure the workpiece between the bending die and the clamp die. In some embodiments the clamp die is configured to engage the wedge plate and move the wedge plate from the retracted position to the engaged position.

Another aspect of the invention includes a die assembly configured to be combined with a bending machine. The die assembly comprises a bending die and a clamp die. The bending die is a split die assembly comprising one or more plates. The plates include one or more movable plates secured between a first stationary plate positioned on one side of the one or more movable plates and a second stationary plate positioned on another side of the one or more movable plates. The bending die includes a channel formed in one or more of the plates around part of its outer circumference, the channel has a width configured to receive a pipe, tube, or other workpiece to be formed. The movable plates are movable between a first position wherein each movable plate is spaced from the adjacent plate (or other surface) a predetermined distance and a second position wherein each movable plate is compressed so there is less distance between the movable plate and the adjacent plate (or other surface). Compression of the movable plates correspondingly reduces the width of the channel to help grasp and hold the workpiece inserted therein. The movable plates are biased in their first position by springs or other suitable means. The split die assembly further includes a wedge plate positioned between the first stationary plate and the second stationary plate. The wedge plate has a first portion that is thicker than a second portion. In some embodiments the wedge plate has a cross section that is generally triangular. The wedge plate is movable between a retracted position and an engaged position and is biased in its retracted position by springs or other suitable means. The wedge plate is movable relative to one or more of the other plates in a direction that is generally perpendicular to the direction of movement of the one or move movable plates. Movement of the wedge plate from its retracted position to its engaged position causes the movable plates to move to from their first position to their second position. The bending die and clamp die are combined with the bending machine such that the clamp die is able to move toward the bending die after the workpiece is positioned within the channel of the bending die to capture the workpiece in the channel between the two dies. In some embodiments the clamp die includes a contacting member configured to engage the first portion of the wedge plate and move the wedge plate from its retracted position to its engaged position as the clamp die moves toward the bending die. The clamp die also includes a channel or groove which corresponds to the channel in the split die assembly to receive and help support the workpiece to be bent.

Another aspect of the invention includes a method of using the bending machine described above. The method includes inserting the workpiece into the channel in the bending die then moving the clamp die toward the bending die so the contacting member of the clamp die engages the wedge plate and moves the wedge plate from its retracted position to its engaged position. As the wedge plate moves to its engaged position, the thicker portion of the wedge provides a force against the movable plates in a direction generally perpendicular to the movement of the wedge plate causing the movable plates to move from their first position to their second (compressed) position. In other words, movement of the wedge plate in one linear direction translates force in another (generally perpendicular) direction against the movable plates causing the movable plates to move in a direction generally perpendicular to the linear movement of the wedge plate. The movement of the movable plates causes the width of the channel in the bending die to decrease so the walls of the channel grip and support the workpiece. The bend arm of the bending machine then rotates both dies around an axis, which may pass through the center of the bending die, to bend the workpiece around the outer circumference of the bending die. Once the bend is completed, the clamp die is retracted from the bending die and the wedge plate returns to its retracted position which allows the movable plates to return to their first position. The width of the channel is expanded and the workpiece is removed from the channel.

DETAILED DESCRIPTION

Figure 1:
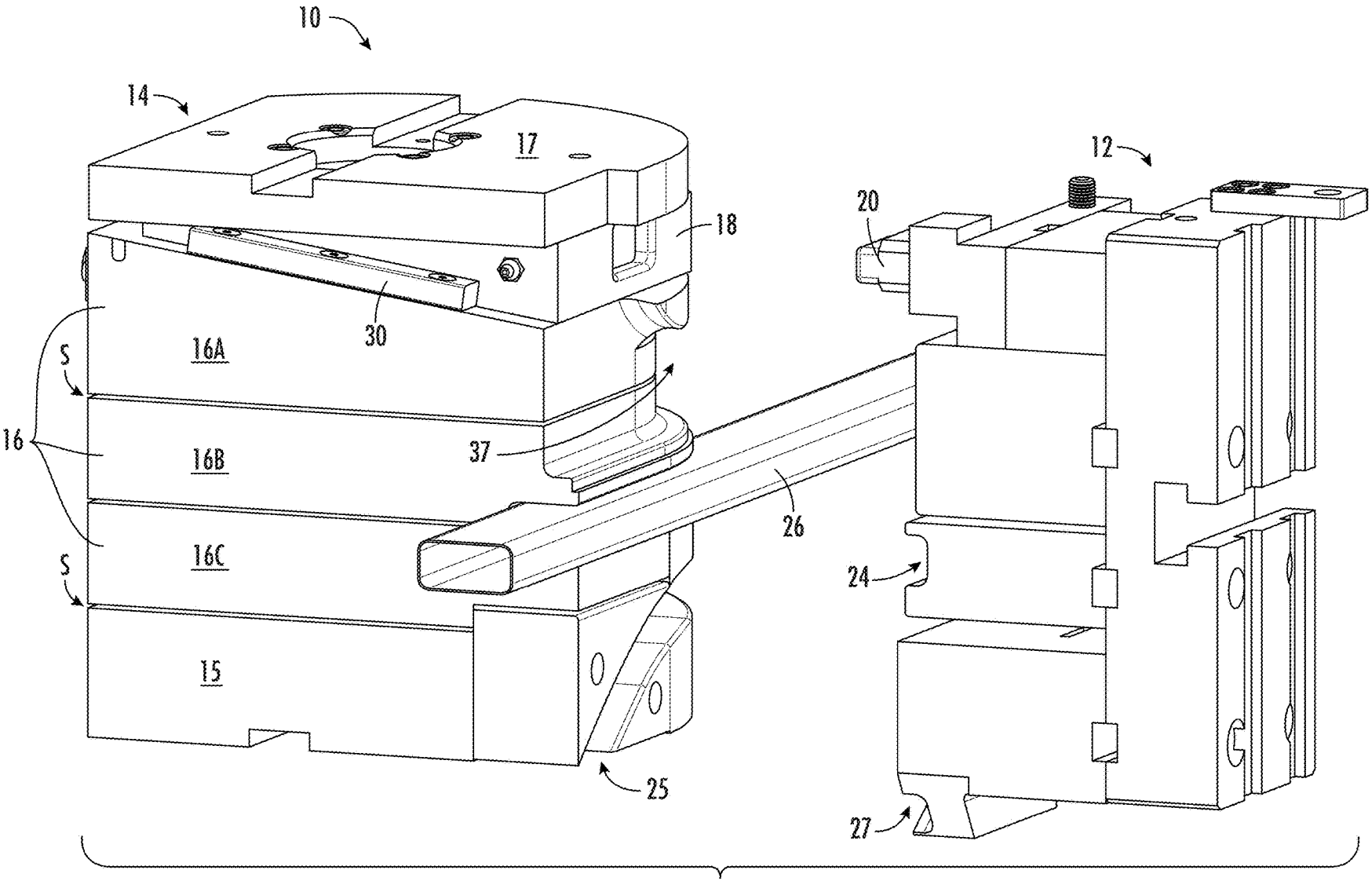
FIG. 1 is a front perspective view of the bending die and the clamp die wherein the clamp die is in the retracted position.

The invention includes a die assembly 10 configured to be combined with a bending machine (not shown). The die assembly 10 comprises a bending die 14 and a clamp die 12. As shown generally in FIGS. 1-6, the bending die 14 is a split die assembly comprising a plurality of members which are herein referred to as plates 15, 16, 17, 18. Unless otherwise specified herein, the plates 15, 16, 17, 18 may be any suitable shape and do not need to take the form of smooth flat thin pieces of material. The plurality of plates includes one or more movable plates 16 secured between a first stationary plate 15 positioned on one side of the one or more movable plates 16 and a second stationary plate 17 positioned on another side of the one or more movable plates 16. The bending die 14 includes one or more channels 22, 25, 37 formed within one or more of the first stationary plate 15, movable plate(s) 16, and second stationary plate 17. The channels 22, 25, 37 have a width configured to receive a pipe or other workpiece 26 to be formed. The clamp die 12 includes one or more channels 24, 27, 38 which correspond to the channel 22, 25, 37 in the bending die 14 to receive and help support the workpiece 26 to be bent.

Figure 2:
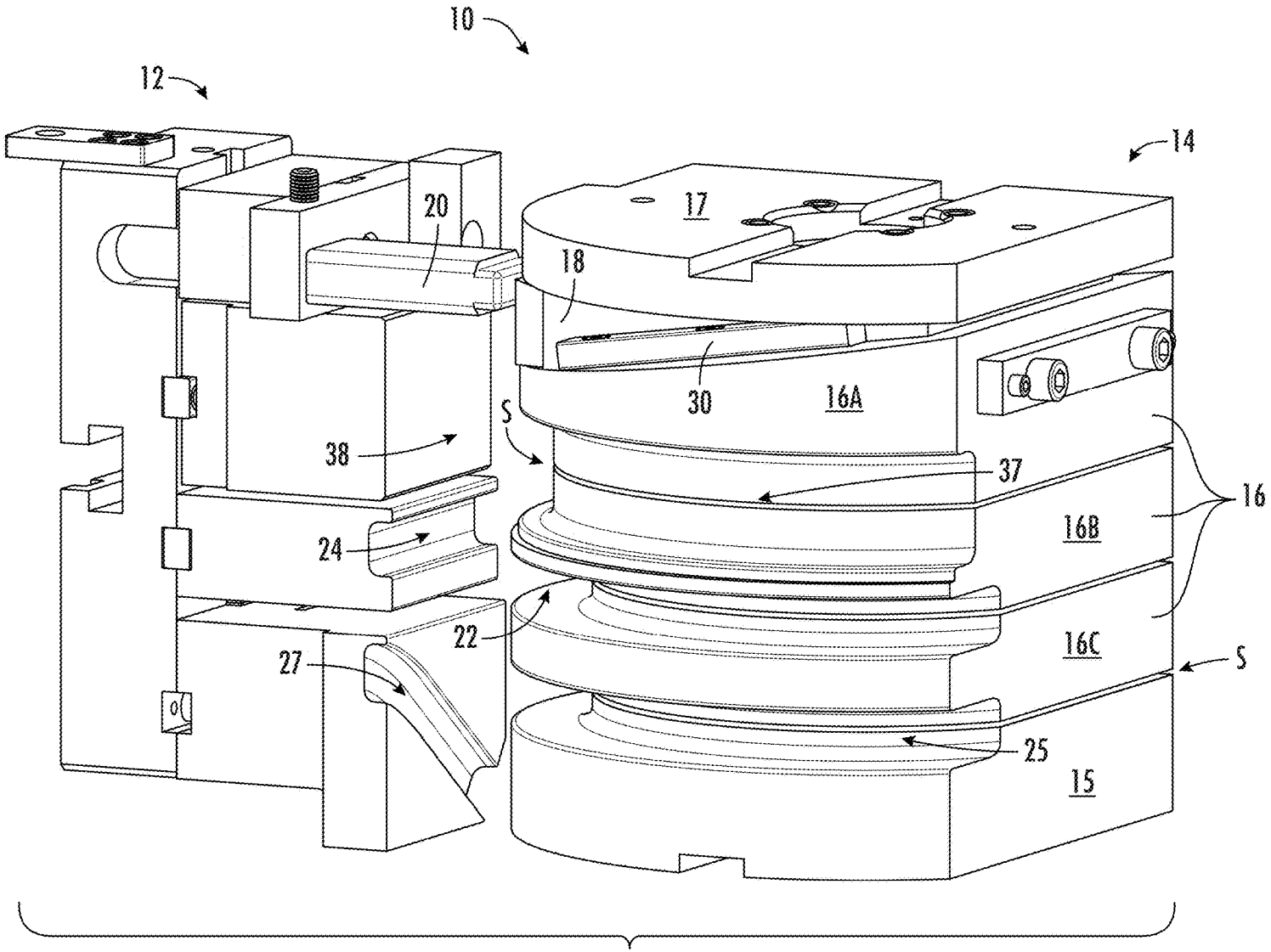
FIG. 2 is a rear perspective view of the bending die and the clamp die wherein the clamp die is in the retracted position.
Figure 3:
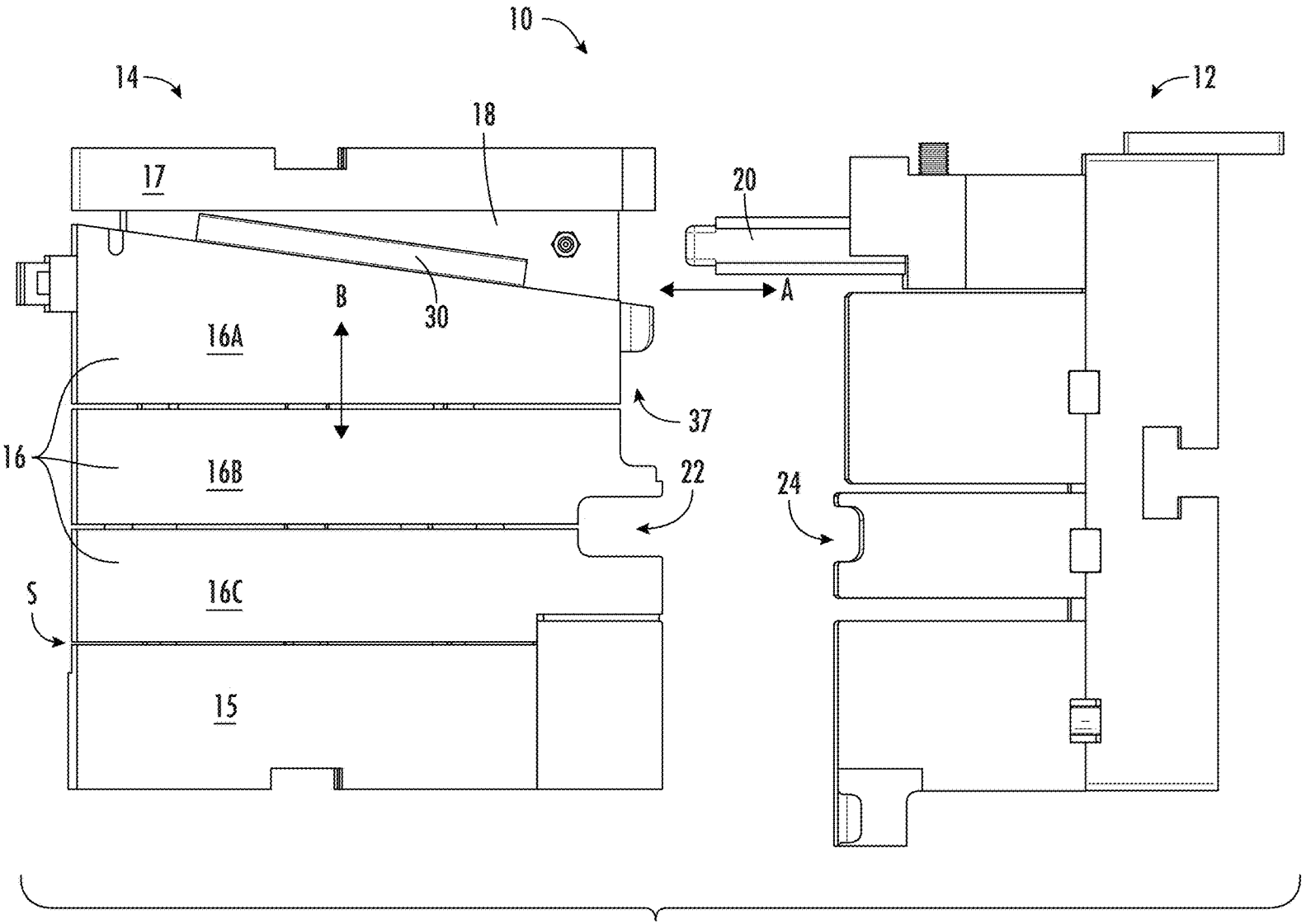
FIG. 3 is a side view of the bending die and the clamp die wherein the clamp die is in the retracted position.
Figure 4:
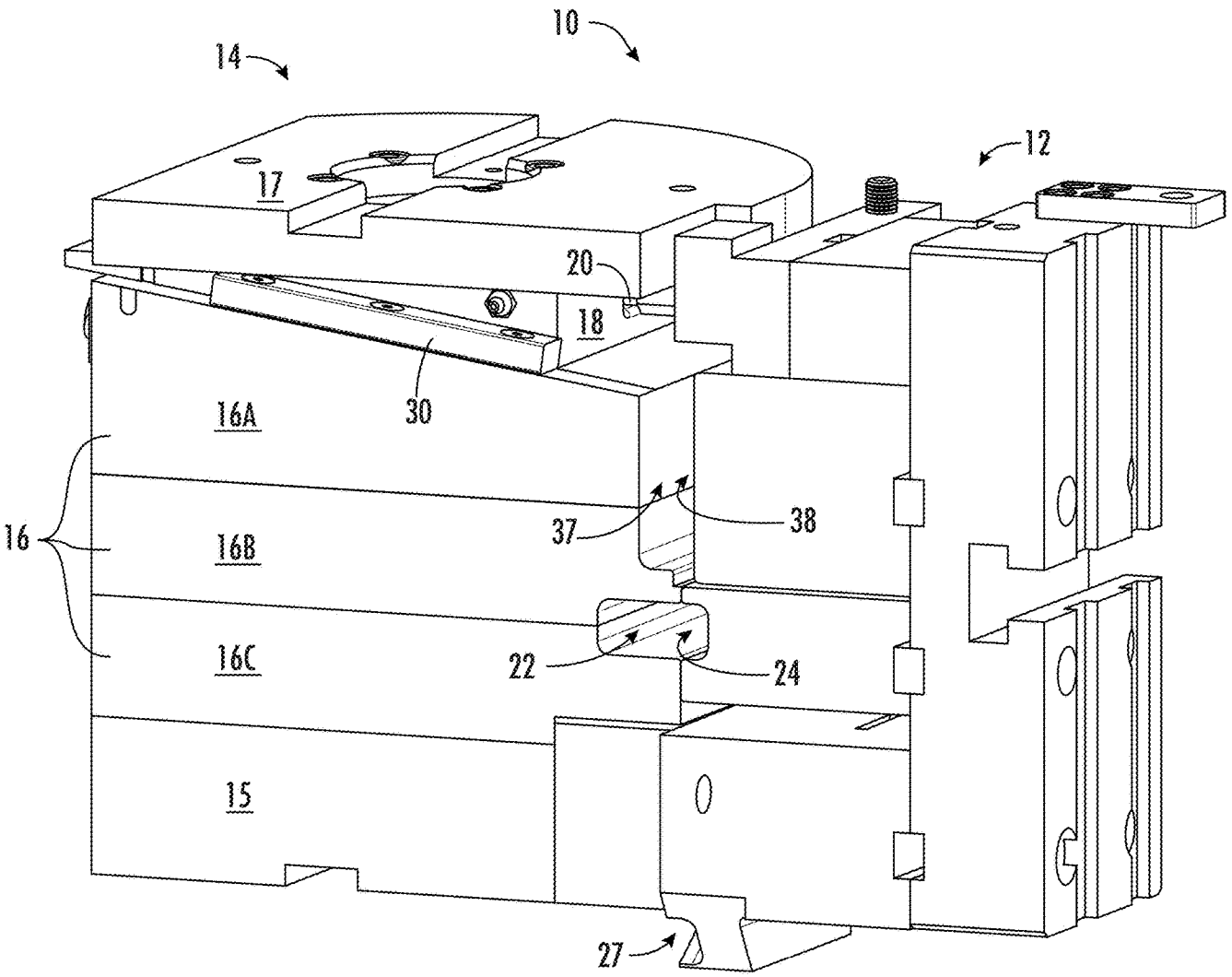
FIG. 4 is a front perspective view of the bending die and the clamp die wherein the clamp die is in the engaged position.
Figure 5:
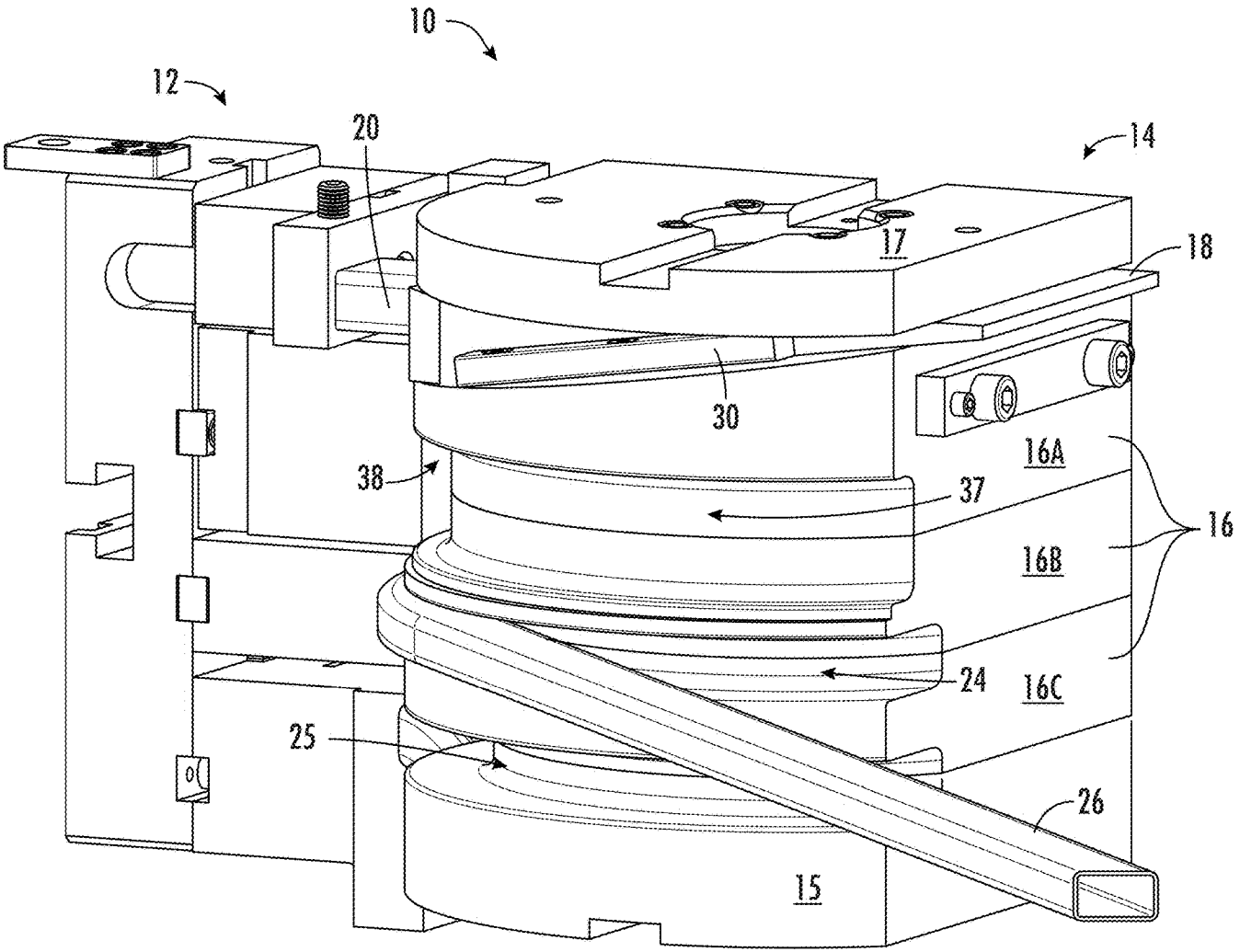
FIG. 5 is a rear perspective view of the bending die and the clamp die wherein the clamp die is in the engaged position.
Figure 6:
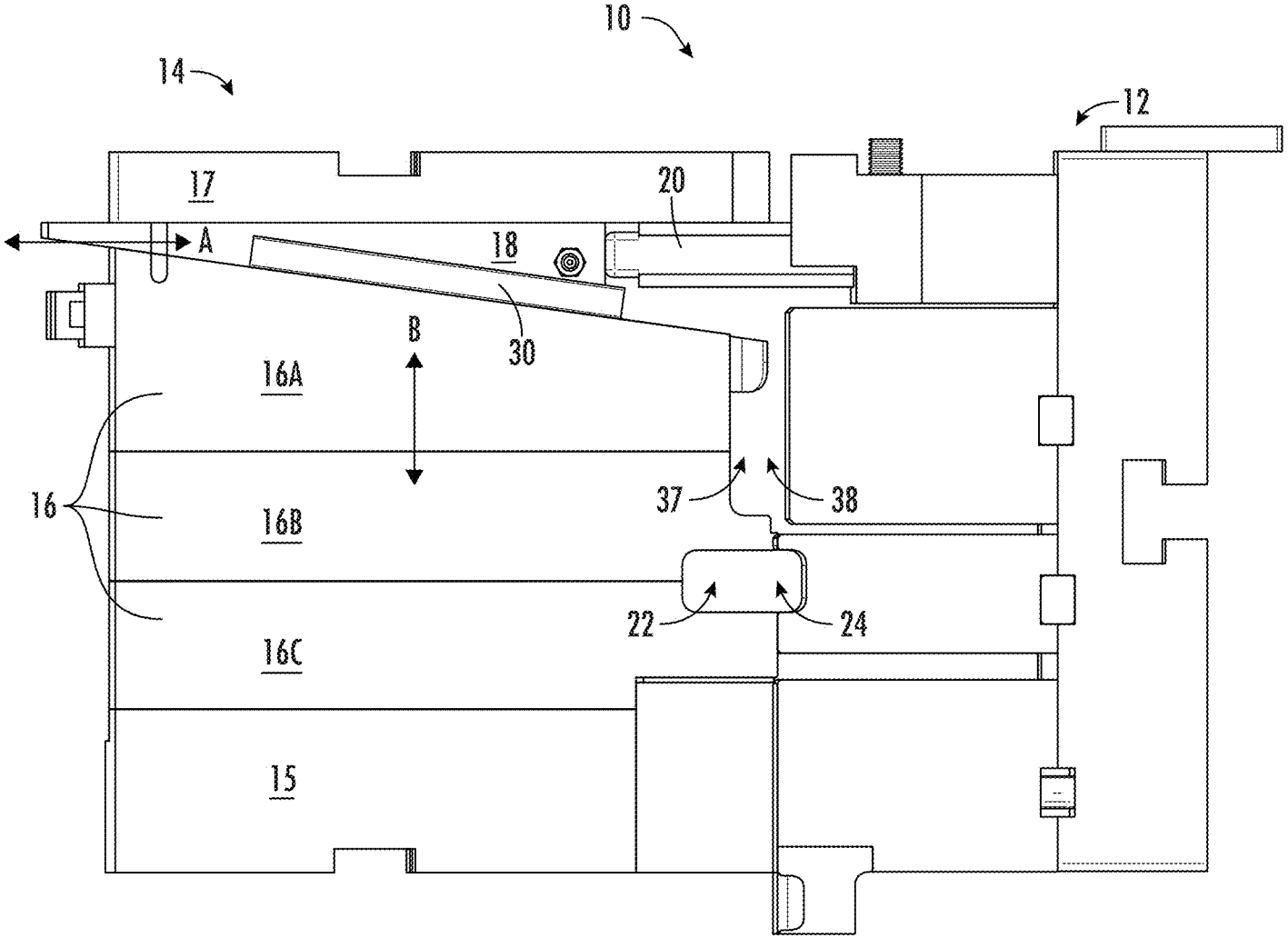
FIG. 6 is a side view of the bending die and the clamp die wherein the clamp die is in the engaged position.

The bending die 14 and clamp die 12 are configured to be combined with the bending machine to move between an extended position wherein a portion of the clamp die 12 engages a portion of the bending die 14 and a retracted position. FIGS. 1-3 show different views of the clamp die 12 in the retracted position and FIGS. 4-6 show corresponding views of the clamp die 12 in the extended position. In the extended position the clamp die 12 engages the bending die 14 after the workpiece 26 is positioned within one of the channels 22, 25, 37 of the bending die 14 to capture the workpiece 26 between the channels 22, 24, 25, 27, or 37, 38 of the two dies 12, 14. As shown best in FIGS. 4 and 6, the channels 22, 24, 25, 27, and 37, 38 in each die 12, 14 generally form a single channel when the two dies 12, 14 are moved toward each other and engaged for the bending operation.

Figure 8:
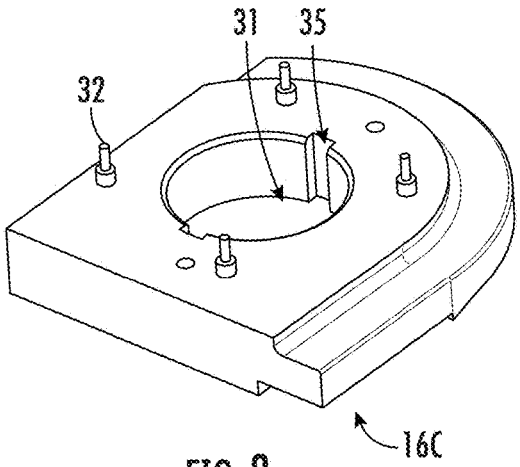
FIG. 8 is a perspective view of one of the movable plates.
Figure 9:
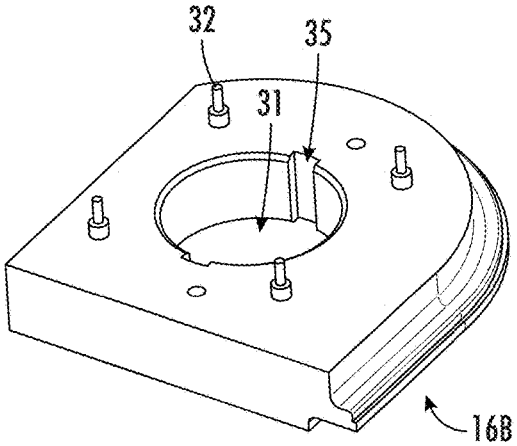
FIG. 9 is a perspective view of one of the movable plates.

As shown best in FIG. 2, the bending die 14 includes one or more channels 22, 25, 37 configured to receive a workpiece 26. The channels 22, 25, 37 may be different sizes or shapes depending on the desired bending operations and the profile of the workpiece. The channels 22, 25, 37 are not wholly within one of the movable plates 16. Instead, each channel 22, 25, 37 is partially within one of the movable plates 16 and partially within an adjacent movable plate 16 or other component, such as the first or second stationary plates 15, 17. As shown, a first channel 22 is partially formed within movable plate 16B and partially formed within adjacent movable plate 16C. Either plate 16B and 16C by itself, does not form a complete channel 22 capable of gripping a workpiece 26 as shown in FIGS. 8 and 9. Similarly, a second channel 25 is partially formed within movable plate 16C and partially formed within the first stationary plate 15. Positioning a part of each channel 22, 25 in two different plates 15, 16, 17 allows the width of each channel 22, 25 to decrease as the movable plates 16 are moved to their second position because it allows the wall of the channel 22, 25 to move relative to another surface.

The one or more movable plates 16 are movable between a first position wherein each plate 16 is spaced from the adjacent movable plate 16 (or other plate 15, 17, 18) a predetermined distance and a second position wherein each movable plate 16 is compressed so there is less distance between the movable plate 16 and the adjacent movable plate 16 (or other plate 15, 17, 18). In the second position where the plates 15, 16, 17, 18 are compressed, the width of the channel 22 is reduced from a first width to a second width to help hold and grasp the workpiece 26. FIGS. 1-3 show different views of the bending die 14 in its retracted position wherein there is a space S between the plates 16 and FIGS. 4-6 show corresponding views of the bending die 14 in its extended position wherein there is little or no space between the plates 15, 16, 17, 18. The movable plates 16 are biased in their first position by springs 32 or other suitable means positioned between the plates 15, 16, 17, 18. The springs 32 may be gas springs such as nitrogen springs.

The plurality of plates of the bending die 14 further includes a wedge plate 18 positioned between the first plate 15 and the second plate 17. The wedge plate 18 is movable between a retracted position and an engaged position along axis A and the movable plates 16 are movable between a first position and a second position along axis B. In some embodiments axis A and axis B are generally perpendicular to each other. The shape of the wedge plate 18 and its movement to the engaged position exerts force on the movable plates 16 causing the movable plates 16 to move from the first position to the second position, as explained below in more detail.

FIGS. 7-10 show the movable plates 16A-16C and the first stationary plate 15 apart from the rest of the bending die 14. Although the embodiment shown in the figures includes three movable plates 16A-16C, any suitable number of movable plates 16 may be used. The movable plates 16A-16C have an opening 31 configured to receive the post 34 (shown in FIGS. 12 and 13). The movable plates 16A-16C are able to slide relative to the post 34 along its length. The bending die 14 may include an alignment means to help keep the plates 16A-16C aligned as they move relative to the post 34. The alignment means may include a recess 35 such as a notch or groove in the plates 16A-16C configured to receive an alignment key 33 extending from the post 34. The alignment key 35 prevents the plates 16A-16C from rotating or twisting on the post 34 as they move along the length of the post 34.

Figure 11:
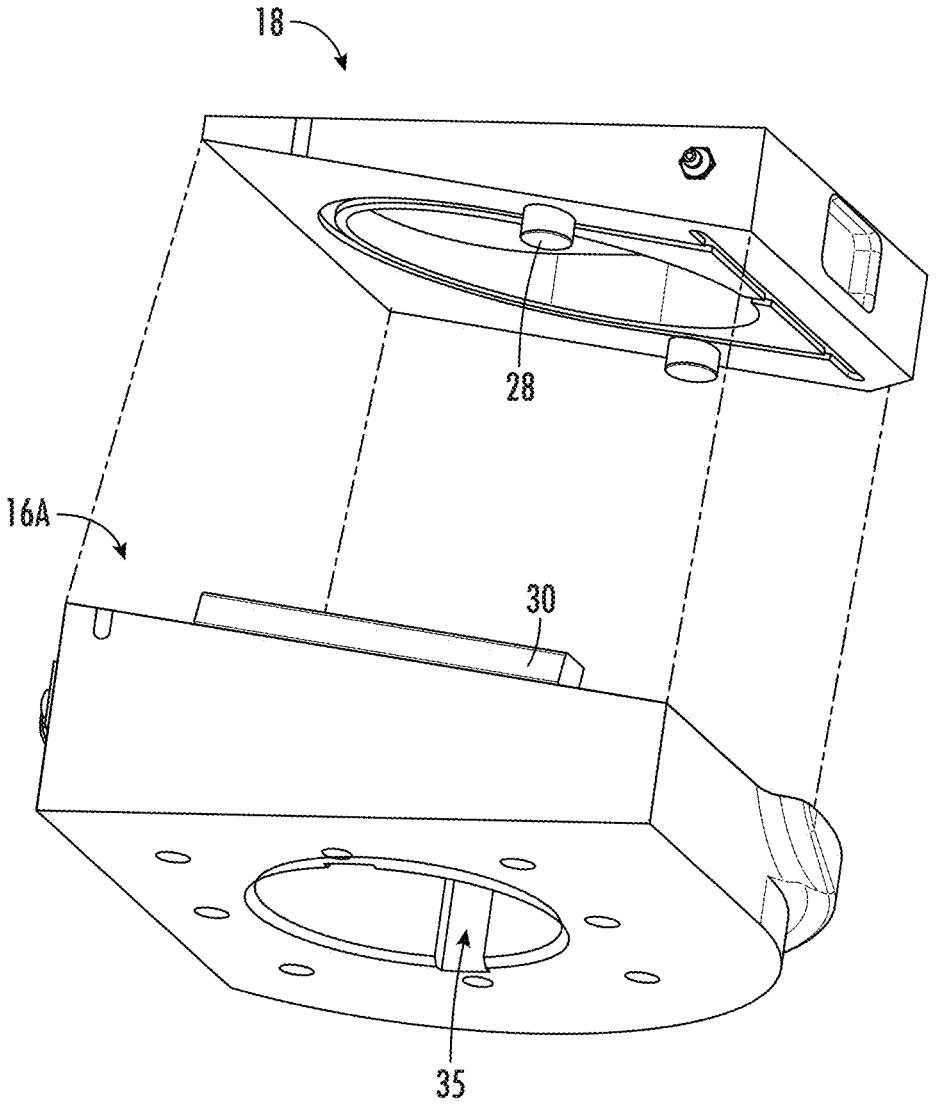
FIG. 11 is a perspective view of the wedge plate separated from the intermediate plate.

As mentioned above, the movable plates 16 are moved from their first position to their second position by an actuating member such as the wedge plate 18. FIG. 11 shows the wedge plate 18 separated from the adjacent movable plate 16A, sometimes referred to here as the intermediate plate 16A. The wedge plate 18 has a first portion that is thicker than a second portion to produce wedge having a mechanical advantage. In some embodiments the wedge plate 18 is generally triangular when viewed from its side, and it may be a right triangle as shown in the figures. Movement of the wedge plate 18 in a first direction along axis A causes the wedge plate 18 to exert a force on the movable plates 16 in a second direction along axis B as the thicker first end of the wedge plate 18 is pushed toward an area with less volume so that movement of the wedge plate 18 in the first direction translates to movement of the wedge plates 16 in a second direction.

As shown, in some embodiments the intermediate plate 16A adjacent to the wedge plate 18 is also angled or wedge shaped to have a thicker portion on the side opposite the thicker first portion of the wedge plate 18. The thicker portion of the intermediate plate 16A is positioned on the same end as the thinner portion (second side) of the wedge plate 18 and a thinner portion on the same end as the thicker portion (first side) of the wedge plate 18. In other words, intermediate plate 16A also has a wedge shape that is positioned opposite from that of the wedge plate 18 in its stacked configuration. The inner surface of the wedge plate 18 slides over the inner surface of the intermediate plate 16A and pushes the intermediate plate 16A in the transverse direction. Guide members 30 may be combined with an outer portion of the intermediate plate 16A to help ensure the wedge plate 18 remains aligned as it moves. The opposing wedge shapes of the two components 16A, 18 allows the outer surfaces of the two plates 16A, 18 (i.e., the surfaces not in contact with each other) to be in a generally horizontal configuration relative to other plates 16B, 17, which allows the plates 17, 18 and 16A, 16B to contact each other over a large surface area. As the wedge plate 18 compresses the movable plates 16, having contact with adjacent plates 15, 16, 17, 18 over a large surface area helps ensure the force is evenly distributed across the plates 15, 16, 17, 18.

Figure 13:
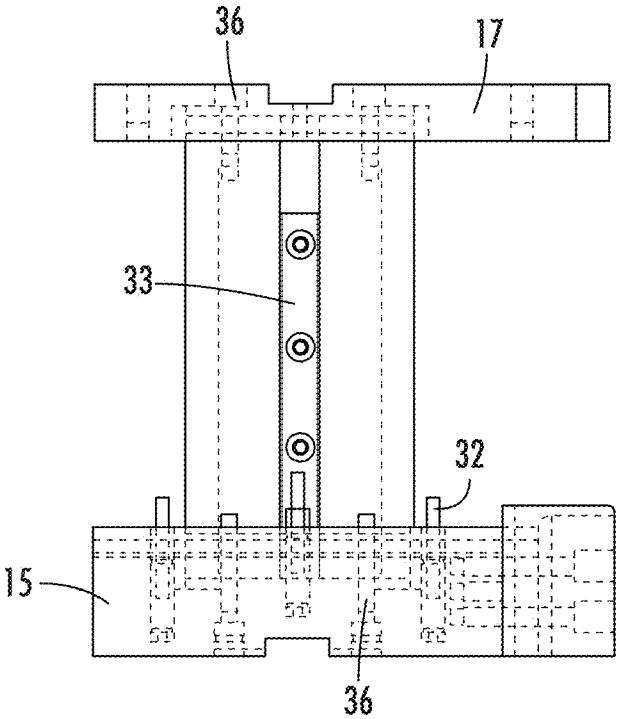
FIG. 13 is a side section view of the first stationary plate and the second stationary plate combined by the die post sleeve.
Figure 12:
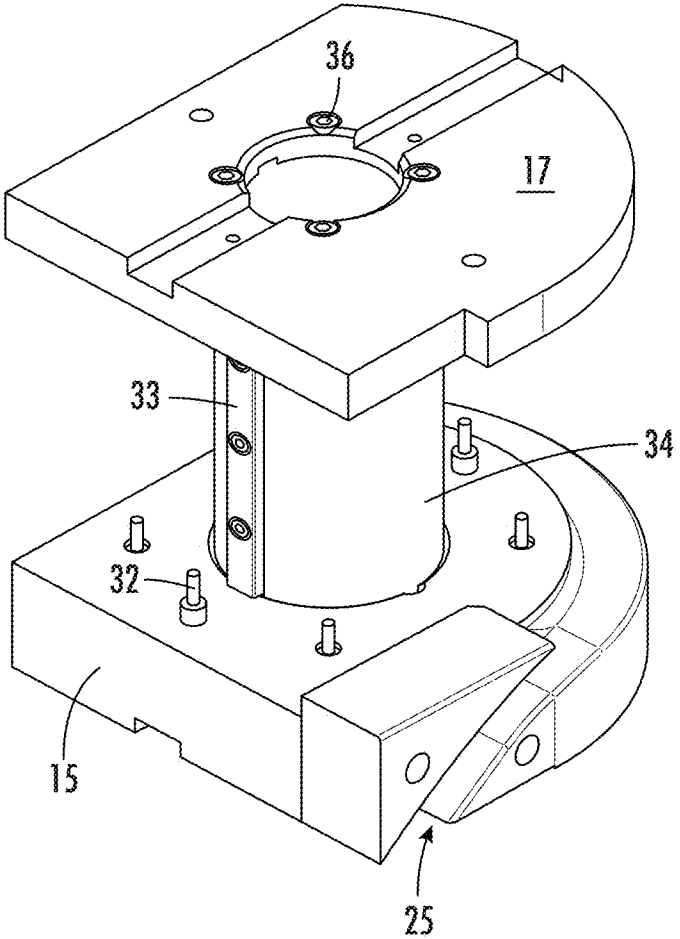
FIG. 12 is a perspective view of the first stationary plate and the second stationary plate combined by the die post.

FIGS. 12 and 13 show the bending die 14 with the movable plates 16 and wedge plate 18 removed. The first stationary plate 15 and second stationary plate 17 are combined with a rigid post member 34. Fasteners 36 such as screws or bolts secure the first plate 15 and the second plate 17 to the post member 34 so the stationary plates 15, 17 cannot move relative to each other along the axis B of compression and decompression. In one embodiment the direction of compression relates to movement of the movable plates 16 downward in a generally vertical direction along axis B and decompression is in the opposite vertical direction.

The wedge plate 18 is movable between a retracted position (FIGS. 1-3) and an engaged position (FIGS. 4-6) by the clamp 12 die. In some embodiments the clamp die 12 has an engagement member 20 extending outward at roughly the same elevation as the wedge plate 18. A motor (not shown) such as an electric motor moves the clamp die 12 toward and into engagement with the bending die 14. The engagement member 20 engages and pushes the wedge plate 18 from its retracted position to its engaged position. In its engaged position, the thicker portion of the wedge plate 18 is pushed toward the thicker end of the intermediate plate 16A forcing all of the movable plates 16 to be compressed between the lower plate 15 and the upper plate 17. As explained above, the first plate 15 and the second plate 17 are fixed to the post 34, so they do not move along the axis B of compression and decompression. The width of the channels 22, 25 in the bending die 14 are similarly compressed to help grasp any workpiece 26 inserted therein. In other embodiments (not shown) an independent clamping system actuates the wedge plate 18 instead of the clamp die 12.

Figure 7:
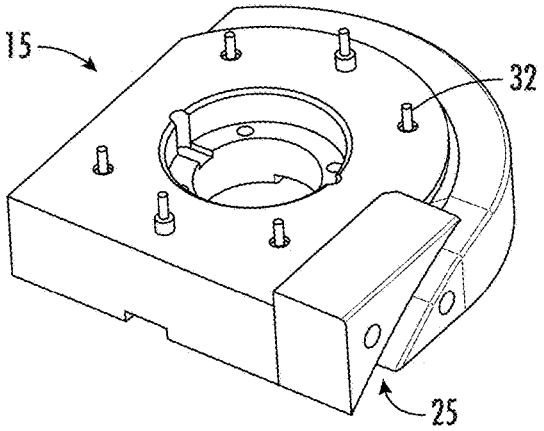
FIG. 7 is a perspective view of the lower plate.
Figure 10:
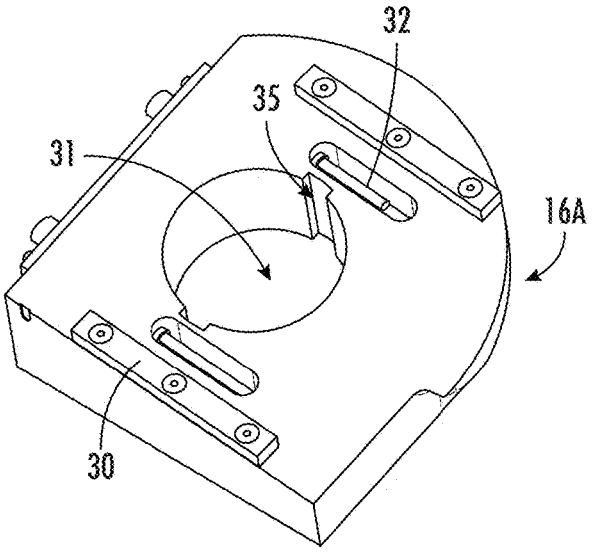
FIG. 10 is a perspective view of the intermediate plate.

The wedge plate 18 is movable relative to one or more of the other plates 15, 16, 17 in a direction that is generally perpendicular to the axis B of compression and decompression so that movement of the wedge plate 18 from its retracted position to its engaged position causes the plates 16 to move to from their first position to their second position. The wedge plate 18 is biased in its retracted position by springs 32 or other suitable means. As shown in FIG. 10, the springs 32 are combined with the intermediate plate 16A. The end of the springs 32 contact a portion of the wedge plate 18, such as members 28 shown extending downward from the wedge plate 18 in FIG. 11. The springs 32 engaged with the wedge plate 18 push the wedge plate 18 along axis A such that the wedge plate 18 is pushed back to its retracted position when the clamp die 12 is retracted to no longer assert force against the wedge plate 18. As the wedge plate 18 moves back to its retracted position, the movable plates 16 also move back to their retracted position by springs 32 (or other suitable means) positioned between the plates 16 to push the plates 16 apart along axis B. The springs 32 are shown in FIGS. 7-9.

Another aspect of the invention includes a method of using the pipe bending machine 10 described above. The method includes inserting the workpiece 26 into the channel 22 in the bending die 14 then moving the clamp die 12 toward the bending die 14 so the contacting member 20 engages the wedge plate 18 and moves the wedge plate 18 from its retracted position to its engaged position. As the wedge plate 18 moves to the engaged position, the angled surface of the wedge plate 18 provides a force against the movable plates 16 in a generally perpendicular direction causing the movable plates 16 to move from their first position to their second (compressed) position. The movement of the plates causes the width of the channel 22 in the bending die 14 to decrease so the walls of the channel 22 grip the workpiece 26. The bend arm of the bending machine then rotates the bending die 14 and the clamp die 12 around an axis, which may pass through the center of the bending die 14, to bend the workpiece 26 around the outer circumference of the bending die 14. Once the bend is completed, the clamp die 12 is retracted from the bending die 14 and the wedge plate 18 returns to its retracted position which allows the movable plates 16 to return to their first position. The width of the channel 22 is expanded and the bent workpiece 26 is removed from the channel 22.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims.

What is claimed is as follows:

1. A die assembly configured to be combined with a bending machine for bending a workpiece, the die assembly comprising:

a bending die having:

a post;

a first plate secured to an upper portion of the post and a second plate secured to a lower portion of the post;

at least two movable plates secured between the first plate and the second plate, wherein the movable plates are movable along the post between a first position and a second position;

a channel at least partially formed in one of the movable plates and configured to receive the workpiece, the channel having a width;

a wedge plate positioned between the first plate and the second plate, wherein the wedge plate is configured to be movable relative to the movable plates between a retracted position and an engaged position, wherein movement of the wedge plate from the retracted position to the engaged position is configured to cause the movable plates to move to from the first position to the second position reducing the width of the channel; and a clamp die configured to move toward the bending die after the workpiece is positioned within the channel to help secure the workpiece between the bending die and the clamp die, the clamp die configured to engage the wedge plate and move the wedge plate from the retracted position to the engaged position.

2. The die assembly of claim 1 further comprising springs between the movable plate, the first plate, and the second plate to bias the movable plate in the first position.

3. The die assembly of claim 1 wherein the wedge plate has a triangular cross section.

4. The die assembly of claim 1 wherein the wedge plate has a first portion that is thicker than a second portion.

5. The die assembly of claim 1 further comprising springs configured to bias the wedge plate in the retracted position.

6. The die assembly of claim 1 wherein the clamp die further comprises a channel which corresponds to the channel in the split die assembly to receive and help support the workpiece.

7. The die assembly of claim 1 wherein the bending die includes three movable plates secured between the first plate and the second plate, wherein each of the three movable plates are movable along the post between a first position and a second position.

8. The die assembly of claim 1 wherein the wedge plate is movable in a direction that is generally perpendicular to the direction of movement of movable plate.

* * * * *